US006241169B1

(12) United States Patent
Björkqvist

(10) Patent No.: US 6,241,169 B1
(45) Date of Patent: Jun. 5, 2001

(54) METHOD AND APPARATUS FOR MECHANICAL DEFIBRATION OF WOOD

(75) Inventor: Tomas Björkqvist, Tampere (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 08/952,458

(22) PCT Filed: May 31, 1996

(86) PCT No.: PCT/FI96/00320

§ 371 Date: Jan. 28, 1998

§ 102(e) Date: Jan. 28, 1998

(87) PCT Pub. No.: WO96/38624

PCT Pub. Date: Dec. 5, 1996

(30) Foreign Application Priority Data

Jun. 2, 1995 (FI) ..... 952730

(51) Int. Cl.[7] ..... B02C 19/12

(52) U.S. Cl. ..... 241/24.29; 241/28; 241/281; 241/293

(58) Field of Search ..... 162/27, 28; 241/27, 241/28, 24.29, 261.2, 261.3, 297, 293, 281, 282

(56) References Cited

U.S. PATENT DOCUMENTS

| | | | | |
|---|---|---|---|---|
| 22,588 | * | 1/1859 | Stanford | 241/261.3 |
| 992,000 | * | 5/1911 | Kihlgren | 241/261.3 |
| 2,769,286 | | 11/1956 | Beth | 51/206.4 |
| 3,132,815 | * | 5/1964 | Wagner | 241/281 |
| 3,153,511 | * | 10/1964 | Atack et al. | 241/281 |
| 3,523,649 | * | 8/1970 | Laakso | 241/261.3 |
| 4,502,643 | * | 3/1985 | Burggrabe | 241/257.1 |

FOREIGN PATENT DOCUMENTS

| | | |
|---|---|---|
| 1411886 | 11/1968 | (DE) . |
| 42781 | 7/1968 | (FI) . |
| 68268 | 4/1985 | (FI) . |
| 309529 | 3/1969 | (SE) . |

OTHER PUBLICATIONS

Derwent's Abstract of SU 698752 dated Nov. 30, 1979.

Sandas, E. "Effects of pulpstone grits in wood grinding." Paper and Timber, vol. 73, No. 9 (1991), pp. 858–861.

* cited by examiner

*Primary Examiner*—John M. Husar
(74) *Attorney, Agent, or Firm*—Ladas & Parry

(57) ABSTRACT

A system for mechanical defibration of wood kneads the wood by moving a defibration surface having contours at least partly in contact with the wood in a direction at a speed in relation to the wood and fibres are separated from the wood. The contours of the defibration surface are at regular intervals in the direction that the speed and the regular intervals determine a cycle time-length that is 1 to 3 times a relaxation time of the wood.

9 Claims, 2 Drawing Sheets

METHOD AND APPARATUS FOR MECHANICAL DEFIBRATION OF WOOD

Figure 1:
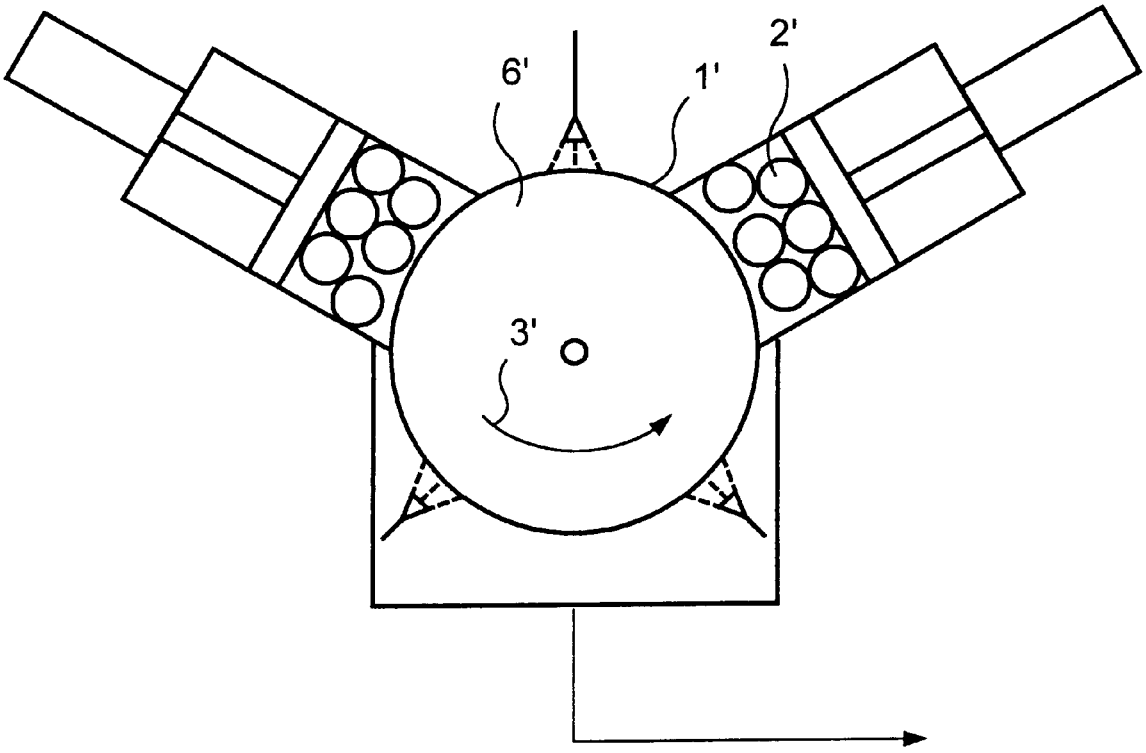
F I G. 1 PRIOR ART

There are several known methods for mechanical defibration of wood. Of these methods, the grinding and refining methods are used in industrial production. Both of these methods are based on kneading of wood raw material by pressure pulses and on mechanical separation of fibres from each other, but the grinding method is more closely related to the present invention. The idea of the kneading is to prepare the wood raw material so that the subsequent mechanical separation of fibres produces pulp suitable for paper making and not only wood fibres separated from each other. The kneading of wood raw material consists of two obligatory parts: fluctuating pressure for breaking the matrix structure of wood, and deformation for softening the wood by the generation of heat energy. In the grinding method, the above-mentioned series of operations is performed by pressing blocks of wood in transverse direction against a rotating cylindrical pulpstone, keeping the longitudinal direction of the blocks of wood parallel to the axial direction of the pulpstone, as disclosed in Swedish Published Specification 309 529. The surface of the pulpstone comprises extremely wear-resistant particles bound to each other by means of a softer binder, whereby they form a random particle construction, as disclosed in Finnish Published Specification 68 268 and U.S. Pat. No. 2 769 286. The difference in altitude in the peripheral direction of the surface, which is due to the random location of particles, generates pressure pulses to the wood raw material and separates fibres from the surface of the wood raw material by means of surface friction. The most significant drawback of both of these mechanical defibration methods is the high energy consumption, which is due to the high generation of heat. The consumption is 10 to 100 times higher than the theoretical energy consumption of defibration disclosed in many connections.

The object of the present invention is to produce pulp suitable for paper making from raw wood by a highly controllable process with a relatively low energy consumption.

The invention is based on the use of a defibration surface that is regular in the peripheral direction instead of a randomly distributed grinding surface. This surface generates regular pressure pulses whose cycle length depends on the peripheral speed employed. The regular defibration surface is provided with a smaller-scale roughened texture, which causes the fibres to be mechanically separated from each other. Such a combination of peripheral speed, regular shape and roughness of the defibration surface is selected that a half of the resulting cycle length corresponds to the average relaxation time of the wood raw material under the defibration conditions, and that the production produced by the roughened surface texture corresponds to the desired production. The relaxation time of wood refers herein to the time it takes the wood raw material to relax freely, within the limits of the amplitude of the basic contour of the surface, from maximum tension to minimum tension in the pretensioned state and conditions in which the defibration takes place. The relaxation time can be measured experimentally in the defibration conditions. A regular defibration surface for achieving the effect described above is novel as compared with the prior art disclosed, for example, in Swedish Published Specification 309 529. The desired defibration surface can be manufactured in different ways, for instance by machining at first and then coating.

The invention has significant advantages.

The method and apparatus of the invention consume energy more efficiently than the methods currently used in the industry. The amplitude of the pressure fluctuation caused by the conventional grinding method is modest in the surface layers of the wood raw material, but the production of heat energy is great in a very thin surface layer. This is because a randomly formed grinding surface causes work cycles whose lengths form a very even distribution. On the other hand, the relaxation time of viscoelastic and non-homogeneous wood raw material in the prevailing conditions falls within a relatively narrow range. These are the reasons that the following work cycle is highly likely to begin at a wrong phase, which causes a significant deformation and production of heat energy in a very thin surface layer. A relatively small part of the mechanical energy is converted to potential energy, and a large part of it is directly converted into heat energy. Potential energy represents the internal tension of the raw material, which breaks the matrix structure and, upon relaxation, is converted into heat energy. Half of the work cycle caused by the method and apparatus of the invention corresponds preferably approximately to the average relaxation time of the wood raw material. It is thus probable that the following amount of work for maintaining the pressure fluctuation is done when the required change in the momentum is small and a large part of the energy can be converted at first into potential energy stored as tension of the wood matrix. The method of the invention thus utilizes as much of energy as possible for the breaking of the structure of the raw material before it is converted into heat energy, which enables efficient use of energy for mechanical defibration of wood. In addition, the method of the invention, in which one property of the defibration surface mainly causes the wood raw material to be kneaded and the other one mainly causes the fibres to be separated, allows these parts of the process to be controlled separately and both these types of work to be done in a sufficient amount but no more than is necessary.

Figure 2:
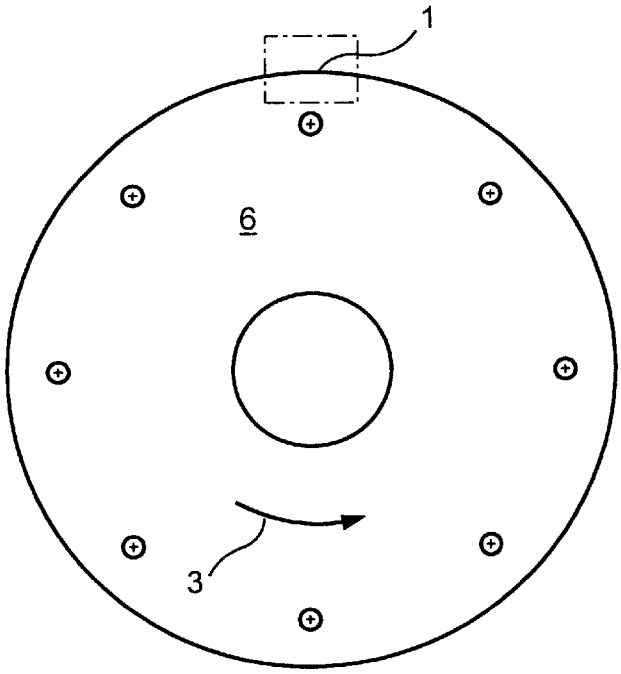
Figure 3:
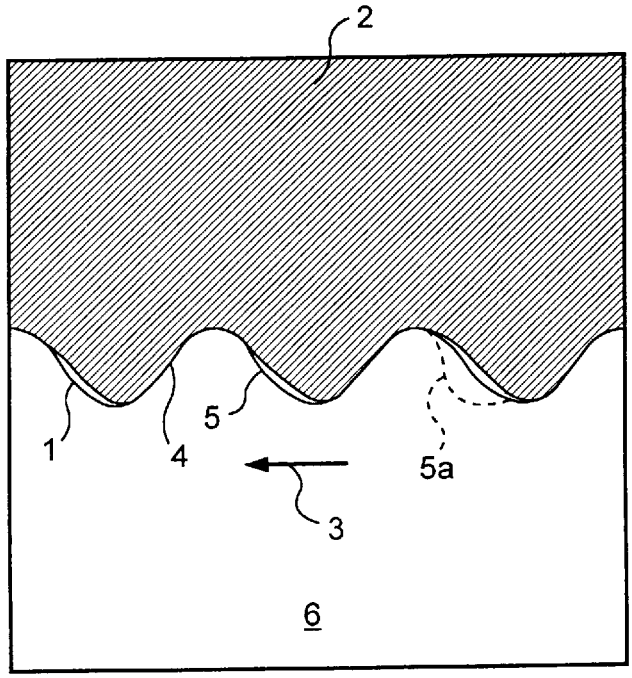

In the following, the invention will be described in greater detail with reference to the accompanying drawings, in which:

FIG. 1 is a schematic axial elevational view, partly in cross section, of a prior art device in which the invention may be used;

FIG. 2 in an axial elevational view of a structural component of the defibration surface according to the invention; and FIG. 3 is an enlarged portion of FIG. 2.

In a prior art apparatus according to the above-mentioned Swedish Published Specification 309 529 shown in FIG. 1, a defibration surface 1' of a structural component 6' rotates with a peripheral speed indicated by arrow 3' against wood 2' shown as raw material.

According to the invention shown in FIGS. 2 and 3, a regular defibration surface 1 is shown as a section in a transverse direction with respect to the axle of the defibration cylinder of structural components 6 (only one shown). Wood raw material 2 (not shown in FIG. 2) is pressed against the defibration surface 1 in such a way that the fibre direction of the wood is parallel to the axial direction of the defibration cylinder. The defibration surface moves at a peripheral speed 3 indicated by arrow with respect to the wood raw material 2. Each wave of the defibration surface consists of a rising portion 4 and a falling portion 5. The defibration surface 1 has a smooth basic texture, but the waves provide it with a roughened texture (not shown in FIG. 2) of a magnitude corresponding to the width of the wood fibres. The waves in the wave pattern are shaped in such a manner that in the rising portion, i.e. from the bottom to the top of the wave, the slope of its tangent grows at first to the maximum value, whereafter it decreases. A model example of such a wave pattern is the sine wave. Such a wave pattern, which is advantageous in view of energy consumption, differs for instance from the regular structure of the defibration surface disclosed in the above-mentioned Swedish Published Specification 309 529; according to this publication, the aim is merely to replace the randomly shaped wear-resistant particles, and there are planar areas between the half-cylindrical or semi-globular particles.

A structural component 6 of the defibration surface can be manufactured, for example, by laser cutting the basic form of the defibration surface from a steel plate. The defibration surface of an entire cylinder is obtained by mounting a plurality of structural components 6 adjacently to form a package, and for instance sintering a roughened texture of hard metal on the surface. Alternatively, the defibration surface can be made of segments whose arc-shaped outer edge is machined and which are mounted successively and adjacently round the cylinder forming the centre of the pulpstone.

The height (amplitude) of the waves and the distance between them is determined in such a way that it is always possible to select such a surface speed that a correct cycle length is obtained for the tree to be defibrated. The amplitude may be of the order of 0.5 mm and the distance between waves of the order of 3 mm, but these are only exemplary values.

The invention works as follows. When the defibration surface 1 moves at a peripheral speed 3 in relation to wood raw material 2, the wood raw material 2 is subjected to regular treatment, the cycle length (i.e., timelength) of which is determined by the contour of the defibration surface 1 and the peripheral speed 3. The rising portions 4 of the defibration surface compress the wood raw material, whereas the falling portions 5 allow the wood raw material 2 to expand. If such a combination of peripheral speed 3 and regular shape of the defibration surface 1 is selected that a half of the resulting cycle length corresponds to the average relaxation time of the wood raw material, it is probable that the following rising portion 4 hits the surface of the wood raw material 2 when the change in the momentum required for maintaining the vibration is small, as shown in FIG. 1. In this case, as much of the consumed energy as possible is at first converted into potential energy stored as the tension of the wood matrix, which enables efficient use of energy for breaking the matrix structure of wood. When tensions build up and relax, part of the energy is converted into heat because of the internal friction of the wood raw material. In practice, this cycle length may vary to some extent, wherefore the length of the entire work cycle may be 1 to 3 times the relaxation time of wood under the prevailing grinding conditions. This is based mainly on the fact that it takes a long time for the wood to recover almost completely, and it is not possible to bring about a sufficient vibration and warming-up phenomenon with such a delay. Since the relaxation process is at first rapid and becomes slower thereafter, it is not sensible to utilize the last part of the relaxation. In practice, the most rapid part of the relaxation is thus utilized; in this part, the wood rapidly returns towards its original state, and when the recovery begins to slow down significantly, new compression will begin. A roughened texture provided on the basic defibration surface 1 separates fibres that have already been kneaded from the surface of the wood matrix, and thus new wood raw material is constantly revealed on the surface of the wood matrix and thereby subjected to the kneading. Since the kneading and separation are fairly independent of each other, the nature of the defibration can be controlled by varying the basic contour and roughness of the defibration surface 1.

One wave pattern of a defibration surface and one method for manufacturing it have been described above. The wave pattern and the manufacturing method may naturally be modified; however, the resulting cycle length must be 1 to 3 times the average relaxation time of the wood raw material, i.e. a half of it corresponds approximately to the average relaxation time. The falling portion of the wave pattern, in particular, must be changed in order to achieve sufficient protective space for the loosened fibres. The broken line 5*a* in Figure indicates another embodiment where the waves are asymmetrical on account of a recession provided in the falling portion. If desired, the basic contour of the defibration surface, which carries out the kneading, and the roughened texture provided on the smooth surface can also be arranged as separate zones successively in the peripheral direction. The wave pattern of an entire cylinder can also be provided at different angles in relation to the peripheral direction. An alternative manufacturing method to laser cutting can be, for example, sufficiently accurate mechanical machining, which can be used, for example, for making grinding segments having a larger surface than thin plates.

What is claimed is:

1. A method for mechanical defibration of wood, the method comprising kneading wood, and separating fibres from the wood by means of the contours of the defibration surfaces, wherein a regular contour of the defibration surface and a correct speed of the surface in relation to the wood to be treated provide a regular cycle time-length which is 1 to 3 times the relaxation time of the wood under the defibration conditions.

2. In a system of wood and an apparatus for mechanical defibration of the wood, the improvements wherein:

the apparatus comprises a defibration surface in contact with the wood and means moving the defibration surface in a direction of a wave pattern thereon, whereby kneading the wood and separating fibres from the wood;

tops of the wave pattern are located at regular intervals in the direction;

the wave pattern is of sine wave type at least at leading portions in the direction; and a distance between the tops and a speed of the moving are such that a cycle time-length of the tops is 1 to 3 times the relaxation time of the wood.

3. The system according to claim 2, wherein:

the defibration surface comprises the wave pattern in a first zone for performing the kneading and a smooth surface with a roughened texture in a second zone for performing the separating, the zones being successive in the direction.

4. The system according to claim 2 wherein the defibration surface consists of outer edges of adjacent plates.

5. The system according to claim 4, wherein the plates are in the form of a disc or ring.

6. The system according to claim 2, wherein the defibration surface consists of segments adjacently and successively around a body forming a centre.

7. In a system of wood and means for mechanical defibration of the wood wherein the wood is kneaded by moving a defibration surface having contours at least partly in contact with the wood in a direction at a speed in relation to the wood and fibres are separated from the wood, the improvements wherein:

the contours of the defibration surface are at regular intervals in the direction; and the speed and the regular intervals determine a cycle time-length that is 1 to 3 times a relaxation time of the wood.

8. The system according to claim 7, wherein the contours are in a wave pattern in the direction of the moving with protrusions for the contact with the wood at the regular intervals, the protrusions being of a sine wave type at least at leading portions in the direction of the moving.

9. The system according to claim 8, wherein the fibers are separated by a surface provided with a roughened texture succeeding the defibration surface in a direction opposite the direction of the moving.

* * * * *